US006543205B1

(12) United States Patent
Faskhoody et al.

(10) Patent No.: US 6,543,205 B1
(45) Date of Patent: Apr. 8, 2003

(54) FORM AND SEAL UNIT FOR A MACHINE FOR PACKAGING POURABLE FOOD PRODUCTS

(75) Inventors: Behrooz Faskhoody, Formigine (IT); Magnus Johansson, Kävlinge (SE); Gert Kostropetsch, Malmo (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 09/702,891

(22) Filed: Nov. 1, 2000

(30) Foreign Application Priority Data

Nov. 18, 1999 (EP) ..... 99830715

(51) Int. Cl.[7] ..... B65B 51/14; B65B 51/30

(52) U.S. Cl. ..... 53/373.7; 53/551; 53/374.5; 53/371.5

(58) Field of Search ..... 53/551, 552, 554, 53/374.5, 374.6, 371.5, 371.6

(56) References Cited

U.S. PATENT DOCUMENTS 4,199,919 A * 4/1980 Moscatelli ..... 53/374.4
4,384,438 A 5/1983 Hilmersson et al.
4,580,392 A 4/1986 Lagerstedt et al.
5,001,891 A * 3/1991 Abate ..... 156/583.5
5,031,386 A * 7/1991 Schneider ..... 53/370.7
5,155,980 A 10/1992 Mansson et al.
6,085,496 A * 7/2000 Fontanazzi et al. ..... 53/551
6,112,498 A * 9/2000 Hansson et al. ..... 53/551

FOREIGN PATENT DOCUMENTS

EP 0 091 712 10/1983
EP 0 265 021 4/1988

* cited by examiner

*Primary Examiner*—Rinaldi I. Rada
*Assistant Examiner*—Hemant M. Desai
(74) *Attorney, Agent, or Firm*—Burns, Doane, Swecker & Mathis, L.L.P.

(57) ABSTRACT

A form and seal unit (1) for producing aseptic sealed packages from a tube (2) of packaging material filled with a pourable food product; the unit having a fixed structure (3), and two forming assemblies (5, 5') interacting alternately and cyclically with the tube (2) of packaging material, and in turn having respective pairs of jaws (7) movable between an open position and a closed position in which the jaws grip the tube (2) of packing material between respective sealing members (13, 14), and respective forming flaps (21) having respective half-shell forming portions (22) which surround the tube (2) of packaging material to determine the shape and volume of the packages; the closing movement of the forming flaps (21) about the tube (2) of packaging material is controlled by cams (30) carried by the forming flaps (21) and interacting with rollers (64) fixed to the structure (3) of the unit (1).

10 Claims, 6 Drawing Sheets

FORM AND SEAL UNIT FOR A MACHINE FOR PACKAGING POURABLE FOOD PRODUCTS

FIELD OF INVENTION

The present invention relates to a form and seal unit for a machine for packaging pourable food products.

BACKGROUND OF THE INVENTION

Machines for packaging pourable food products, such as fruit juice, wine, tomato sauce, pasteurized or long-storage (UHT) milk, etc., are known in which the packages are formed from a continuous tube of packaging material defined by a longitudinally sealed strip.

The packaging material has a multilayer structure comprising a layer of paper material covered on both sides with layers of heat-seal material, such as polyethylene. In the case of aseptic packages for long-storage products, such as UHT milk, the packaging material comprises a layer of barrier material, defined for example by an aluminium film, which is superimposed on a layer of heat-seal plastic material, and is in turn covered with another layer of heat-seal plastic material defining the inner face of the package eventually contacting the food product.

In the manufacture of aseptic packages, the strip of packaging material is unwound off a reel and fed through an aseptic chamber in which it is sterilized, e.g. by applying a sterilizing agent such as hydrogen peroxide, which is subsequently evaporated by heating, and/or by subjecting the packaging material to radiation of appropriate wavelength and intensity; and the sterilized strip is folded into a cylinder and sealed longitudinally to form, in known manner, a continuous, longitudinally sealed, vertical tube. That is, the tube of packaging material forms an extension of the aseptic chamber, and is filled continuously with the pourable food product and then fed to a form and (transverse) seal unit for producing the individual packages, and in which the tube is gripped between pairs of jaws to seal the tube transversely into pillow packs, which are then separated by cutting the sealing portions between the packs.

More specifically, the portion of the tube pressed between the jaws is simultaneously sealed transversely by heating means, e.g. induction or ultrasonic, carried by the jaws. Once the sealing operation is completed, a cutter is activated to cut the tube of packaging material along the center of the sealed portion and so cut a pillow pack off the bottom end of the tube. Since the bottom end is sealed transversely, the jaws, on reaching the bottom dead center position, can be opened to prevent interfering with the top part of the tube. At the same time, the other pair of jaws, operated in exactly the same way, moves down from the top dead center position to repeat the above gripping/forming, sealing and cutting operations.

The pillow packs are then fed to a final folding station where they are folded mechanically to form the finished packages.

Known units also comprise, for each pair of jaws, two forming flaps, which are positioned facing each other, are hinged to the jaws, and are movable between a withdrawn or open position, and a forward or closed position in which they meet, in the closed position of the jaws, to define a cavity defining the shape and volume of the package to be formed in between.

In one known solution, the closing movement of the forming flaps is governed by cams fixed to the structure of the machine, and which interact with respective rollers carried by the tabs.

Machines of the above type have proved highly successful commercially and extremely reliable, to the extent of requiring very little maintenance even after many years' service.

On the other hand, such machines have several drawbacks, mainly in terms of flexibility.

Though adaptable to produce packages of different volumes, machines of the above type call for major alterations, which consist in changing the forming flaps on the jaws, and all the parts, even static (such as the cams), governing the closing movement of the tabs, as well as adjusting the new system. Besides the cost of manufacturing the replacement components, such alterations therefore involve a good deal of downtime.

In the technical sector considered, a demand therefore exists for a form and seal unit enabling fast changeover in the size of the packages, with no major alterations to the machine.

SUMMARY OF THE INVENTION

According to the present invention, therefore, there is provided a form and seal unit as claimed in claim 1.

According to the present invention, therefore, there is provided a form and seal unit for producing aseptic sealed packages, containing a pourable food product, from a tube of packaging material filled with the food product and fed along a vertical path. The unit comprises a fixed structure and two forming assemblies interacting alternately and cyclically with the tube of packaging material, and having respective slides movable vertically in reciprocating manner with respect to the structure. Respective pairs of jaws are carried by the slides, and have sealing members movable between an open position and a closed position in which the sealing members cooperate with the tube of packaging material; and including respective pairs of forming flaps. Each forming flap is carried by a respective one of the jaws and have a half-shell forming portion; the forming flaps of each forming assembly being movable between a withdrawn position spaced from said tube, and a forward position in which said respective half-shell forming portions enclose said tube. In the closed position, the respective jaws form a cavity of predetermined volume. The unit includes cams for controlling the closing movement of the forming flaps from the withdrawn position to the forward position, and includes cams carried by the forming flaps and interacting, during the movement of said jaws, with rollers fixed to the structure.

DESCRIPTION OF THE DRAWINGS

A preferred embodiment of the present invention is described with reference to the accompanying drawings, in which.

DETAILED DESCRIPTION OF THE INVENTION

Figure 1:
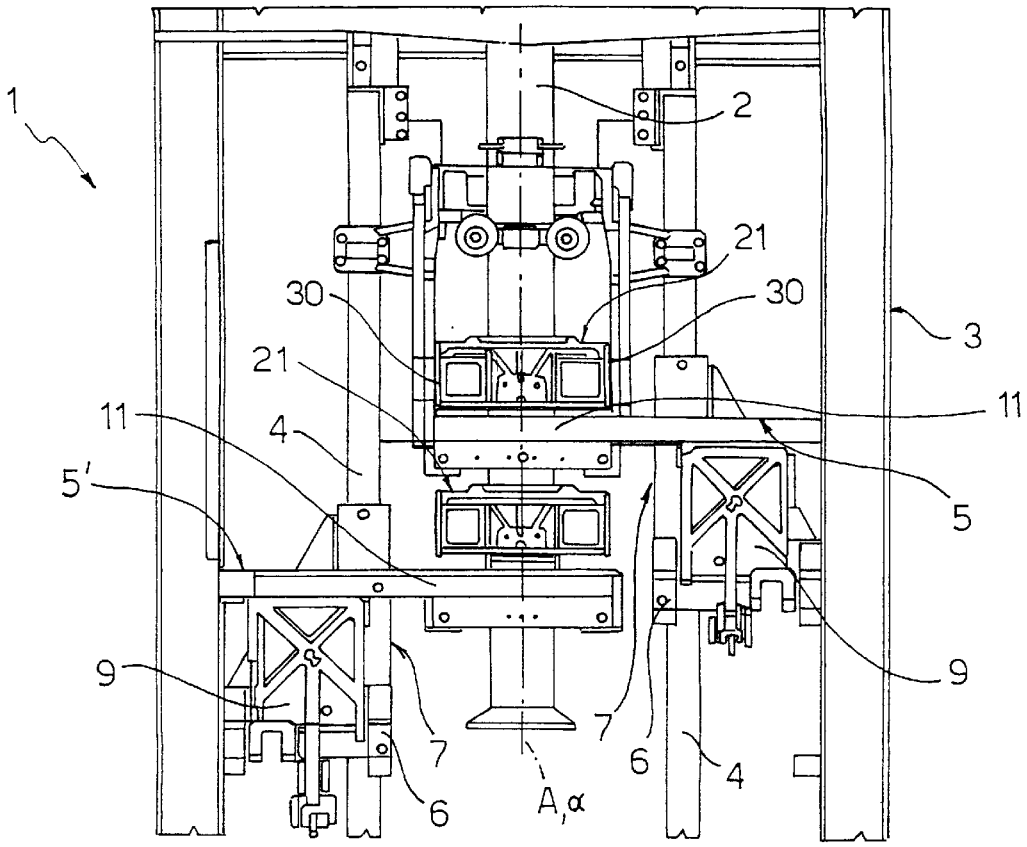
FIG. 1 shows a schematic front view of a form and seal unit for a machine for packaging pourable food products, in accordance with the invention.
Figure 2:
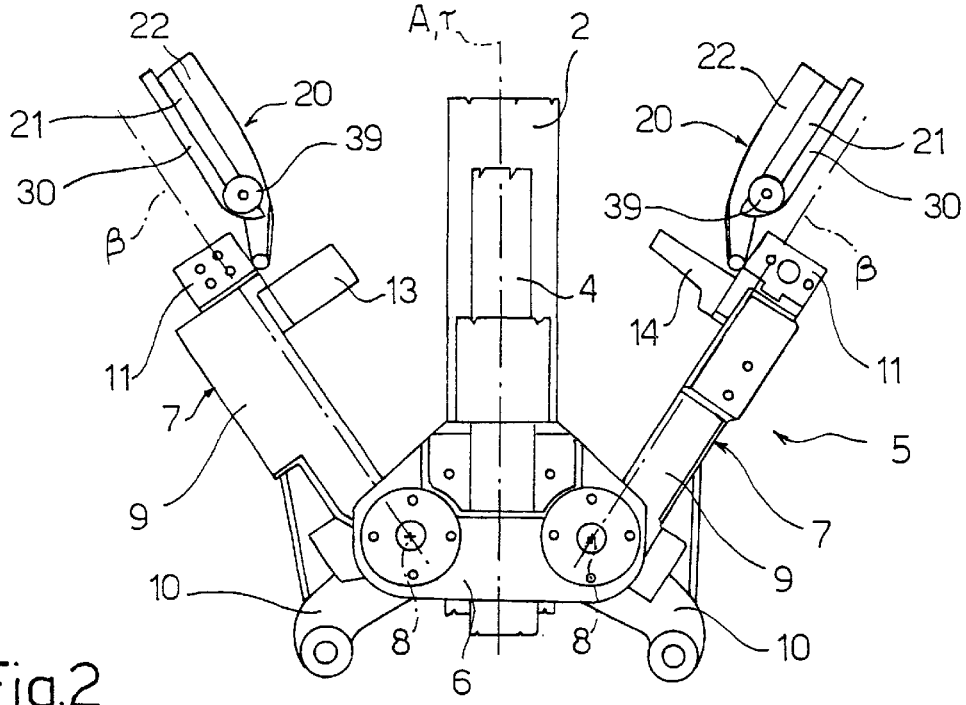
FIG. 2 shows a schematic, partial side view of a form and seal assembly of the FIG. 1 unit.
Figure 3:
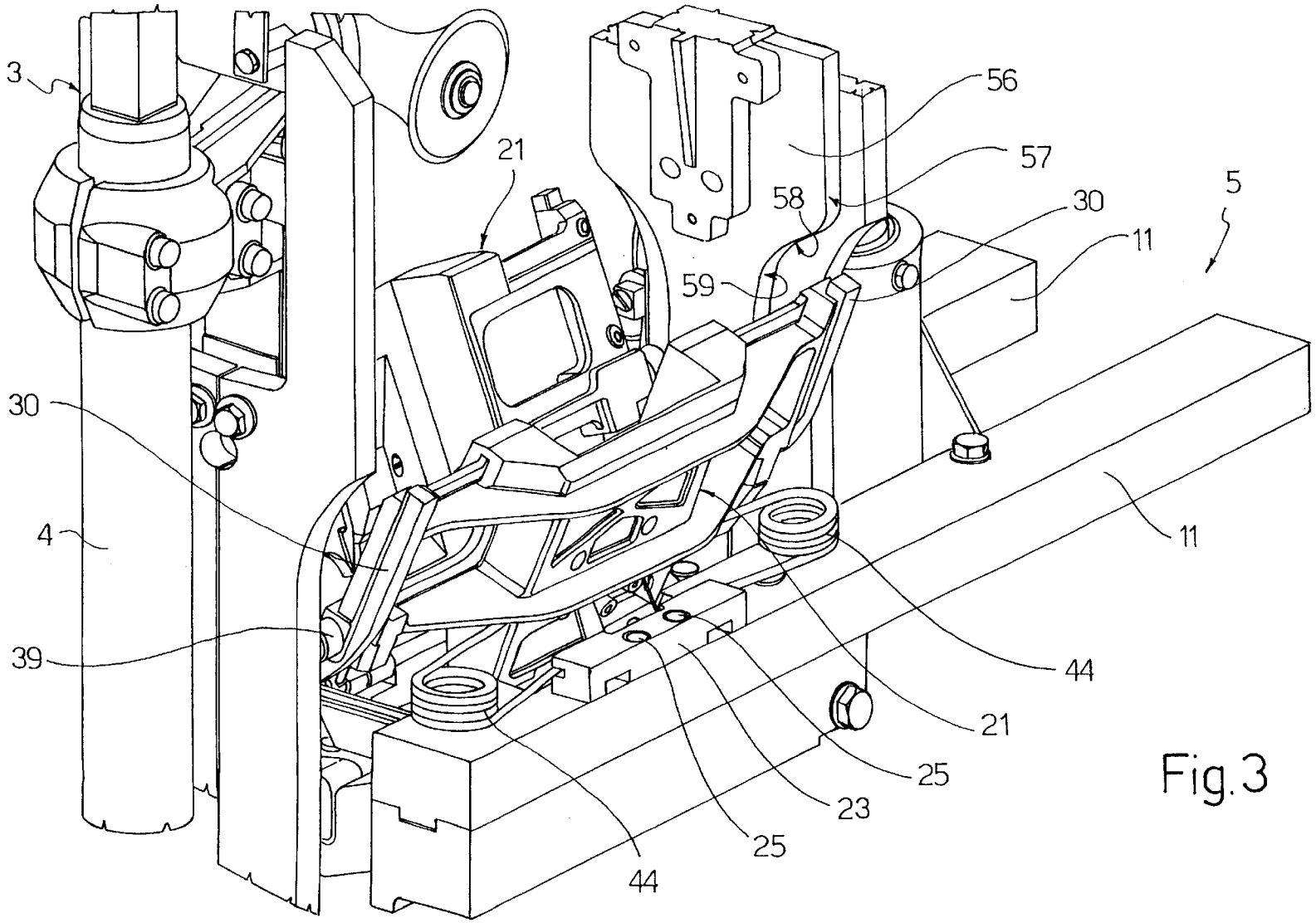
FIG. 3 shows a partial view in perspective, with parts removed for clarity, of the opposite side of the FIG. 1 assembly.

Referring to FIGS. 1 to 3, a machine for packaging pourable food products, such as pasteurized or UHT milk, fruit juice, wine, etc. includes a form and seal unit 1.

More specifically, the unit 1 produces aseptic sealed packages, containing a pourable food product, from a tube 2 of packaging material (FIG. 1) formed by longitudinally folding and 'sealing a strip of heat-seal sheet material, and filled with the food product upstream from unit 1.

Tube 2 is fed to unit 1 in known manner along a vertical path defined by an axis A.

Unit 1 comprises a supporting structure 3 defining two vertical guides 4 located symmetrically with respect to a vertical longitudinal mid-plane $\alpha$ of the unit through axis A, and the axes of which lie in a vertical mid-plane $\tau$ crosswise to unit 1, so that axis A defines the intersection of planes $\alpha$ and $\tau$.

Unit 1 has two conventional forming assemblies 5, 5' movable vertically along respective guides 4, and which interact alternately with tube 2 of packaging material to grip and heat seal cross sections of the tube.

Since the two assemblies 5, 5' are symmetrical with each other with respect to plane $\alpha$, only one (assembly 5) is shown in detail in FIGS. 2 and 3 and described below. Moreover, since assemblies 5, 5' are known, only the parts pertinent to the present invention are described, the corresponding parts of assemblies 5, 5' being indicated in the drawings using the same reference numbers.

With reference to FIG. 2, assembly 5 substantially comprises a slide 6 running along respective guide 4; and two jaws 7 hinged at the bottom to the slide about respective horizontal axes 8 parallel to and symmetrical with respect to plane $\tau$, so as to open and close substantially "book-fashion."

More specifically, each jaw 7 comprises a main control body 9—substantially in the form of an appropriately ribbed quadrangular plate (FIG. 1) extending along a work plane $\beta$ of jaw 7 containing respective axis 8—which is hinged, close to its own bottom side, to slide 6 and comprises a respective control arm 10 projecting from the face of body 9 facing away from plane $\tau$.

Jaws 7 also comprise respective supporting arms 11, which are fixed to the top ends of respective bodies 9 of respective jaws 7 and project towards and beyond plane $\alpha$, in a direction parallel to respective axes 8 and substantially along respective work planes $\beta$, so as to be located on opposite sides of tube 2.

The projecting portions of arms 11 are fitted with respective bar-shaped sealing members 13, 14 (FIG. 2) designed to interact with tube 2, and which may be defined, for example, by an inductor for generating current in the aluminium layer of the packaging material and Joule-effect melting the thermoplastic layer, and by a mating backup pad to grip the tube to the required pressure.

The reciprocating movement of slides 6 and the opening/closing movement of jaws 7 are controlled in known manner (not described) by pairs of vertical rods (not shown) in turn controlled by rotary cams or servomotors.

Figure 11:
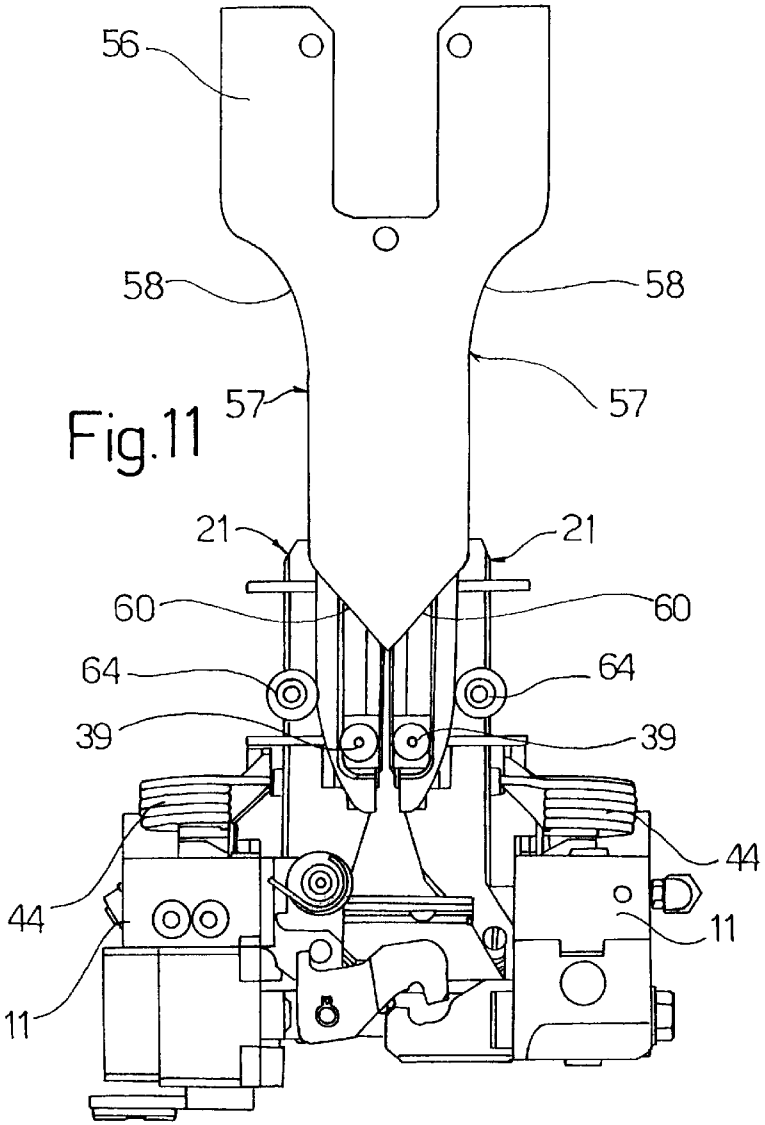
Figure 10:
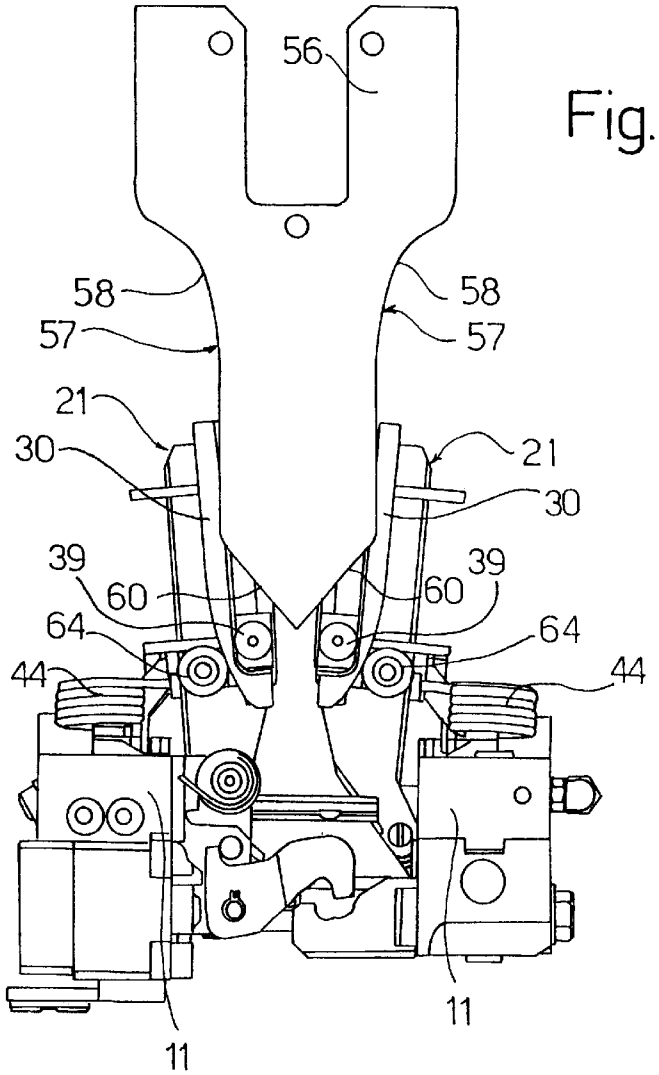

Jaws 7 are movable between a closed position, in which respective sealing members 13, 14 grip tube 2 (FIG. 11), and a fully-open position (FIG. 2).

Figure 5:
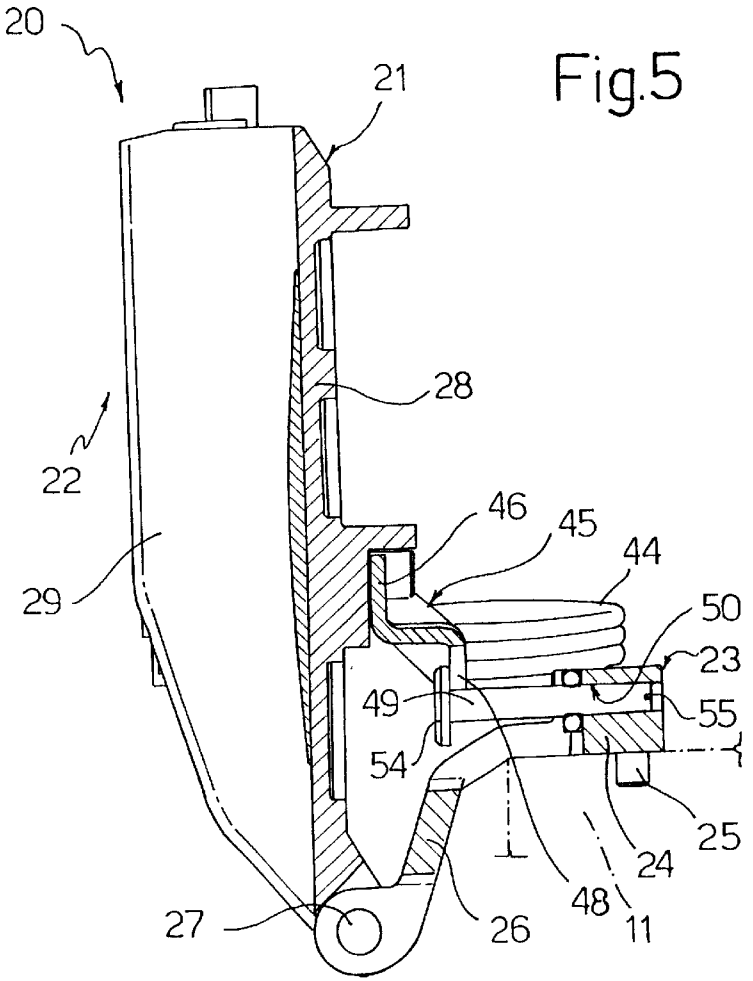
FIG. 5 shows a middle cross section of the FIG. 4 assembly.
Figure 4:
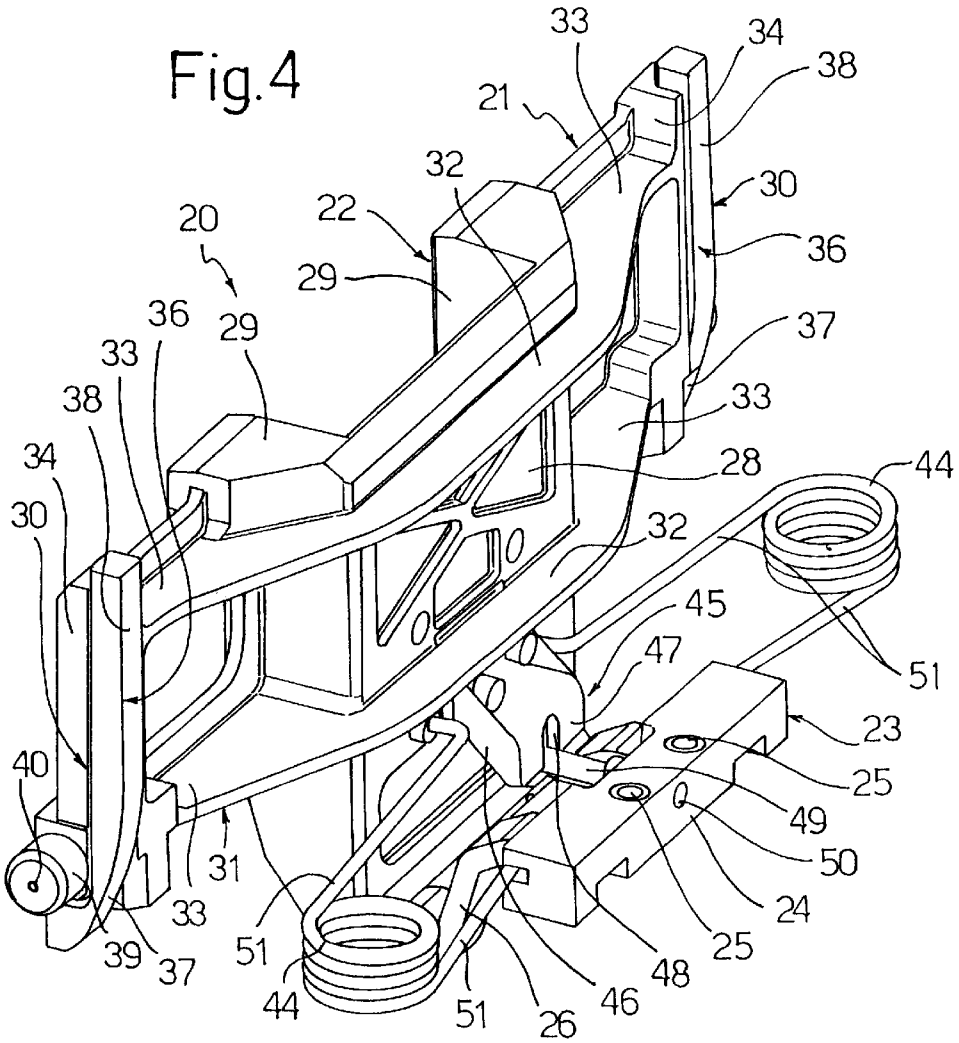
FIG. 4 shows a view in perspective of a package volume control assembly of the FIG. 1 unit.

Over respective sealing members 13, 14, arms 11 of jaws 7 are fitted with respective package volume control assemblies 20 (FIGS. 4 and 5).

Assemblies 20 comprise respective forming flaps 21 hinged to jaws 7 and having, in known manner, respective half-shell portions 22, which have a C-shaped cross section open at the front, and cooperate with each other during the formation of the packages to enclose and form tube 2 into a rectangular-section configuration corresponding to that of the finished packages.

Each assembly 20 (FIGS. 4 and 5) also comprises a supporting member 23 fixed rigidly to a respective arm 11, and to which respective forming flap 21 is hinged. More specifically, supporting member 23 comprises an elongated-bar-shaped connecting portion 24 fitted by two screws 25 to a respective arm 11; and an appendix 26 projecting frontwards (i.e. towards plane $\tau$) and downwards from a mid-portion of portion 24, and the free end of which is fitted with a hinge pin 27 for supporting forming flap 21 and having a horizontal axis perpendicular to plane $\alpha$. Half-shell portion 22 is hinged to pin 27 at the bottom end of a bottom wall 28 of portion 22.

Half-shell portion 22 is defined laterally by two walls 29 projecting frontwards from opposite sides of bottom wall 28, and decreasing gradually in height towards the bottom end of half-shell portion 22 to avoid interfering with the complementary half-shell portion 22 as the two are brought together about tube 2.

Each tab 21 also comprises two closing-travel control cams 30 located on either side of half-shell portion 22 and carried by a supporting structure 31 integral with portion 22. More specifically, supporting structure 31 comprises two parallel beam members 32 extending crosswise to, and along the outer lateral surface of, half-shell portion 22, and having respective end portions 33 projecting beyond lateral walls 29. Supporting structure 31 also comprises two supporting members 34, substantially in the form of L sections, which extend parallel to respective lateral walls 29 of half-shell portion 22, on opposite sides of portion 22, and are connected integrally to end portions 33 of the beam members. Cams 30 are fitted to respective supporting members 34, and each comprise a work surface 36 facing away from plane $\tau$ and comprising a first bottom lead-in portion 37 with a gradually increasing lift, and a straight, constant-lift second portion 38.

Each forming flap 21 also comprises two rollers 39 governing the approach movement towards tube 2, and which are fitted idly to respective pins 40 projecting laterally from respective supporting members 34.

Each forming flap 21 is pushed by two springs 44 into a forward or closed position (FIGS. 4 and 5) defined by an adjustable stop device 45, and in which bottom wall 28 is substantially parallel to the work plane $\beta$ of the respective jaw.

Device 45 substantially comprises a stop member 46 fitted to the back of bottom wall 28 of half-shell portion 22 and having a fork-shaped end 47 defining a downward-open groove 48, and a screw 49 screwed inside a through hole 50 formed in supporting member 23 and having an axis perpendicular to plane $\beta$ of respective jaw 7. Screw 49 is fitted through groove 48 in stop member 46, and comprises a head 54 resting axially against fork-shaped end 47, and a slot 55 formed in the opposite free end to permit adjustment through hole 50.

Springs 44 are helical flexure springs, have respective arms secured to tab 21 and to supporting member 23, and are loaded to exert thrust on tab 21 to keep stop member 46 against head 54 of screw 49.

The movement of forming flaps 21 towards tube 2 of packaging material is controlled in known manner by two fixed cams 56 (FIGS. 3 and 6–10) connected to the machine structure, on either side of path A, and which interact with rollers 39 of forming flaps 21. Cams 56 are defined by flat plates parallel to plane τ, and each comprise two work profiles 57 (FIGS. 6–10), which are defined by respective lateral edges of the respective plate, are symmetrical with respect to plane τ, and interact simultaneously with respective rollers 39 located on the same side of the two forming flaps 21 forming part of the same forming assembly 5 or 5'.

More specifically, each work profile 57 comprises a curved, concave, top input portion 58 at a gradually decreasing distance from plane τ; a straight, vertical intermediate portion 59; and a straight inclined output portion 60 converging with respect to plane τ, at which the two output portions 60 meet.

The closing movement of forming flaps 21 is controlled by cams 30 of forming flaps 21 contacting respective pairs of fixed rollers 64 located on either side of plane α, immediately downstream (i.e. beneath) respective fixed cams 56.

More specifically (FIGS. 6–10), the rollers 64 in each pair are located symmetrically with respect to plane τ, beneath respective output portions 60 of respective fixed cam 56.

The form and seal unit 1 operates as follows.

Jaws 7 of each assembly 5, 5' close as the assembly moves down, so as to grip tube 2 with a vertical downward component of motion equal to the traveling speed of tube 2. As they move down, jaws 7 are kept closed, and sealing members 13, 14 grip the tube with sufficient pressure to heat seal it. Close to the bottom dead center position, jaws 7 open to release tube 2 and are opened fully during the upward movement and prior to reaching the top dead center position. At which point, the jaws begin closing again as described above.

The movement of the two assemblies 5, 5' is obviously offset by a half-cycle: the upward movement of assembly 5 with jaws 7 open being performed simultaneously with the downward movement of assembly 5' with the jaws closed, so that arms 11 of assembly 5' pass between the arms of assembly 5 with no interference.

Forming flaps 21 on jaws 7 interact with tube 2 of packaging material in coordination with the action of the jaws; and the approach and closing movements of tabs 21 towards and about the tube are controlled respectively by fixed cams 56 interacting with rollers 39 of forming flaps 21, and by cams 30 integral with forming flaps 21 interacting with fixed rollers 64.

The operating sequence, with reference to forming assembly 5 only, is shown in FIGS. 6–10.

Figure 6:
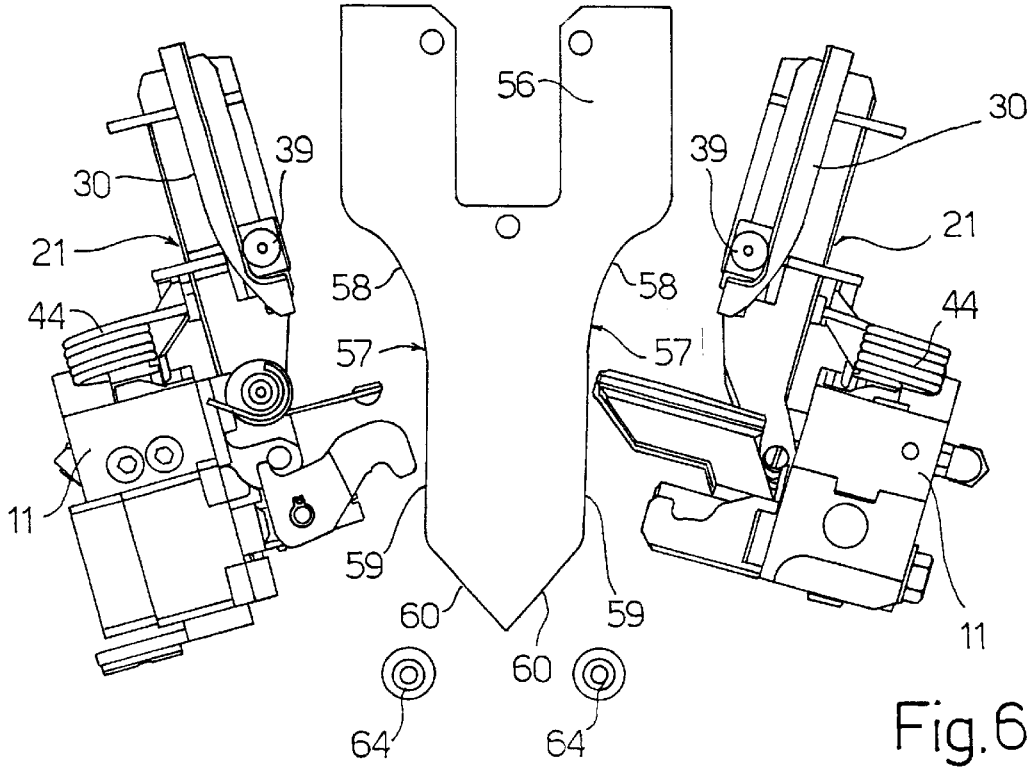
FIGS. 6, 7, 8, 9, 10 and 11 show schematic, partial side views of the FIG. 1 unit at different operating stages.
Figure 7:
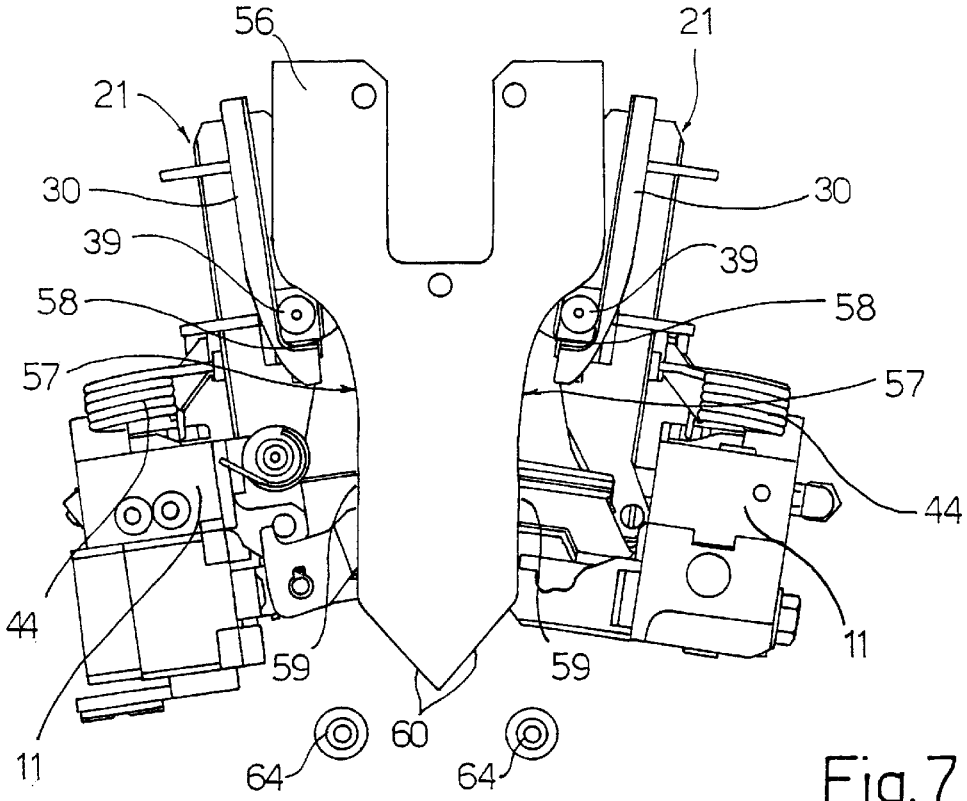
Figure 9:
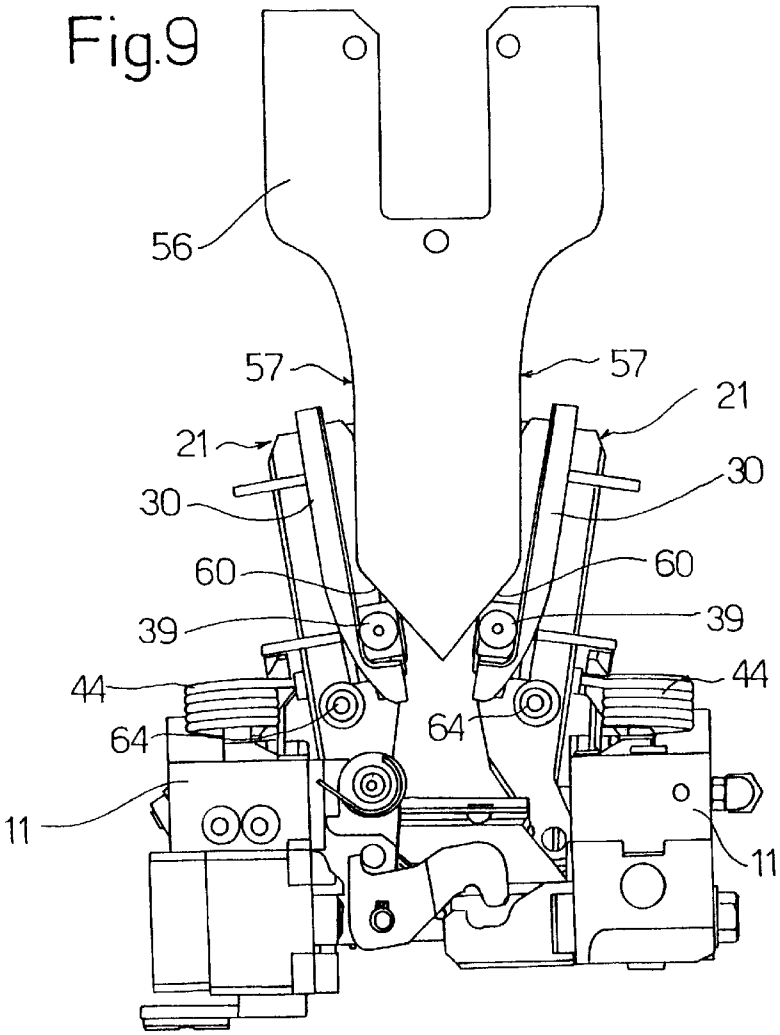
Figure 8:
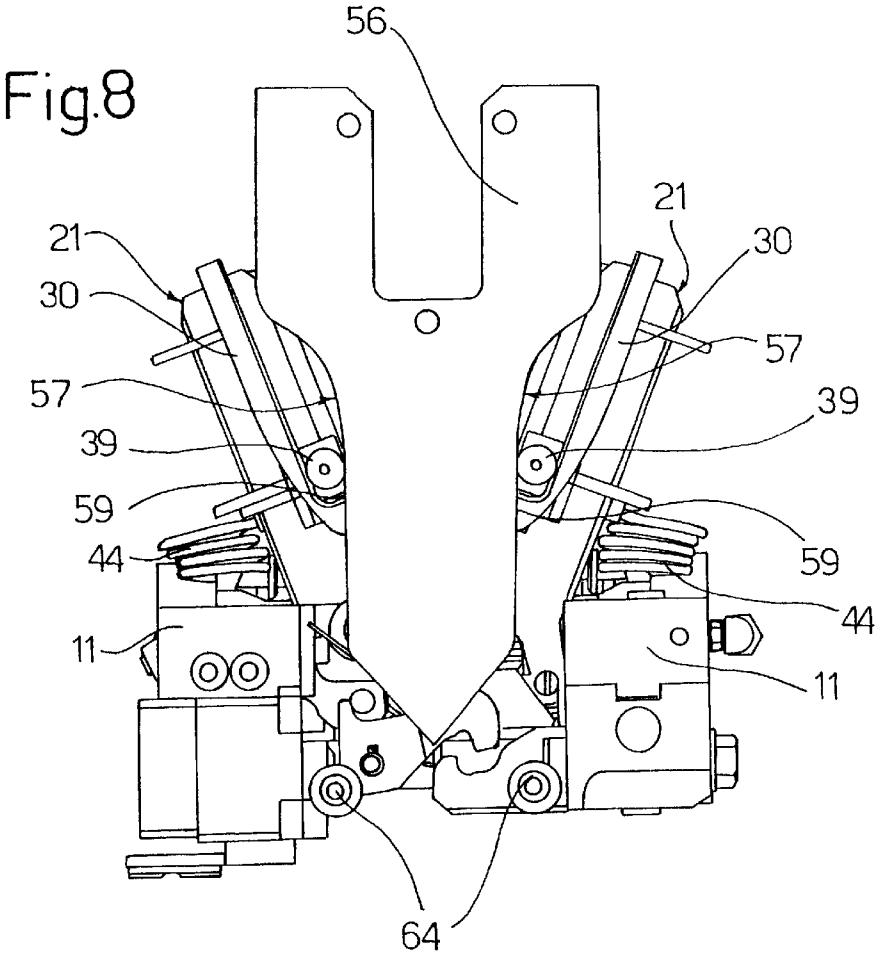

In FIG. 6, jaws 7 are shown on the point of interacting with tube 2, and tabs 21, still some distance from the tube, are maintained in the closed position by springs 44.

Upon sealing members 13, 14 contacting tube 2, but prior to the tube being contacted by tabs 21 (FIG. 7), rollers 39 of forming flaps 21 contact the top input portions 58 of- cams 56, so that tabs 21 are moved gradually, at portions 58, into a withdrawn or open position (FIG. 8), which is maintained along vertical intermediate portions 59 of fixed cams 56, along which the movement of jaws 7, by now closed, is also vertical.

At output portions 60 of cams 56 (FIG. 9), tabs 21 are gradually allowed to close about tube 2 by virtue of the thrust of springs 44. Immediately downstream from cams 56, control of the movement of forming flaps 21 is taken over by cams 30, which come into contact with fixed rollers 64, to counteract the pressure inside tube 2 and accurately define the volume of the package being formed. FIG. 1 shows tabs 21 in the fully closed position, which is reached at portions 38 of cams 30, and in which half-shell portions 22 fully surround tube 2 and substantially mate to impose on tube 2 the shape and volume of the inner cavity defined by half-shell portions 22.

Tabs 21 are maintained positively by cams 30 in the above closed position until cams 30 get past fixed rollers 64.

This occurs after jaws 7 of the other forming assembly 5' have gripped the next sealing portion of tube 2 to close the package being formed, so that jaws 7 of assembly 5 can therefore be opened to withdraw forming flaps 21 from the package.

The advantages of form and seal unit 1 according to the present invention will be clear from the foregoing description.

In particular, according to the present invention, the closing movement of forming flaps 21 is governed by cams 30 on the tabs themselves, as opposed to fixed cams, so that the volume of the packages may be altered by simply changing tabs 21 (which, being specially designed for a particular type of package, must be changed anyway at each changeover in production), but with no alterations to the static components of the machine. To control the approach movement, in fact, the same cams 56, appropriately sized, have been found to be usable for different package volumes.

In the preferred embodiment described, package volume control assemblies 20 constitute preassembled integrated units, by all the "volume-dependent" parts, such as tabs 21, respective cams 30, springs 44 and adjustable stop device 45, being carried by a single supporting member 23 fitted extremely simply and easily to jaw 7. Intervention time and consequent downtime are therefore reduced to a minimum.

Finally, devices 45 provide for fast, effective adjustment of package volume control assemblies 20.

Clearly, changes may be made to the unit as described herein without, however, departing from the scope of the accompanying Claims.

What is claimed is:

1. A form and seal unit for producing aseptic sealed packages, containing a pourable food product, from a tube of packaging material filled with the food product and fed along a vertical path comprising:

a fixed structure and two forming assemblies interacting alternately and cyclically with the tube of packaging material, and having respective slides movable vertically in reciprocating manner with respect to the structure;

respective pairs of jaws being carried by the slides, and have sealing members movable between an open position and a closed position in which the sealing members cooperate with the tube of packaging material;

respective pairs of forming flaps being carried by a respective one of the jaws and have a half-shell forming portion, the forming flaps of each forming assembly being movable between a withdrawn position spaced from said tube, and a forward position in which said respective half-shell forming portions enclose said tube;

cams for controlling the closing movement of the forming flaps from the withdrawn position to the forward position, and includes cams carried by the forming flaps and interacting, during the movement of said jaws, with rollers fixed to the structure;

wherein in the closed position, the respective jaws form a cavity of predetermined volume.

2. The unit as claimed in claim 1, comprising a supporting member for each said forming flap; releasable connecting means to fix said supporting member rigidly to a respective said jaw; and hinge connecting means between each said supporting member and the respective said forming flap.

3. The unit as claimed in claim 2, comprising elastic means interposed between each said supporting member and the respective said forming flap to push said forming flap into said forward position.

4. The unit as claimed in claim 3, comprising an adjustable stop device associated with each said forming flap and defining said forward position of the forming flap.

5. The unit as claimed in claim 4, wherein each said stop device comprises a stop member connected rigidly to the respective forming flap; and a screw screwed inside said supporting member and having a head cooperating with said stop member by virtue of the thrust of said elastic means.

6. The unit as claimed in claim 5, wherein said stop member has a fork-shaped end; and in that said screw is fitted through said fork shaped end and rests on the fork-shaped end, on the opposite side to said supporting member.

7. The unit as claimed in claim 5, wherein said screw is screwed inside a through hole in said supporting member, and has a slot on a free end.

8. The unit as claimed in claim 1, wherein each of said forming flaps comprises a pair of said cams located on opposite sides of said half-shell forming portion; said unit comprising two pairs of said rollers, located symmetrically with respect to the path (A) of said tube to interact with the respective said pairs of cams of said forming flaps of each said forming assembly.

9. Apparatus for forming and sealing packages containing a pourable product comprising:

a frame;

a pair of forming assemblies mounted on the frame and movable vertically relative to the frame, the forming assemblies each including a pair of sealing jaws mounted on arms movable about an axis between an open and closed position;

guide member for guiding a tube of packaging material in a vertical direction relative to the frame, the jaws of the respective forming assemblies being position on opposite sides of the guide member when in the open position and upon moving to a closed position the jaws pinch the tube of packaging material between the jaws;

each forming assembly having a spring biasing the sealing jaws toward a closed position;

each forming assembly have a pair of forming flaps spaced from the axis a greater distance then the sealing jaws, the forming flaps having a pair of rollers;

a fixed cam mounted on the frame and having a first cam surface in position to be engaged by the pair of rollers, the fixed cam having a second cam surface, the first cam surfaces being spaced vertically from the second cam surfaces, the first cam surface being formed to open the sealing jaws upon upward movement of the forming assembly relative to the frame, and the second cam surface being formed to close the sealing jaws and the forming flaps upon downward movement of the forming assembly relative to the frame, each forming assembly having a pair of cams for engagement with a pair of fixed guide rollers during downward movement of the forming assembly, said fixed guide rollers being secured to said frame.

10. The apparatus as claimed in claim 9, wherein the forming flaps each have a screw for adjusting the position of the flaps when the flaps are in a closed position.

* * * * *